US005163849A

United States Patent [19]

Fogg et al.

[11] Patent Number: 5,163,849

[45] Date of Patent: Nov. 17, 1992

[54] LEAD FRAME AND ELECTRICAL CONNECTOR

[75] Inventors: Michael W. Fogg, Harrisburg; John A. Hackman, Elizabethtown; Kenneth E. Markle, York; John R. Shuey, Mechanicsburg, all of Pa.

[73] Assignee: AMP Incorporated, Harrisburg, Pa.

[21] Appl. No.: 750,677

[22] Filed: Aug. 27, 1991

[51] Int. Cl.[5] ..... H01R 9/07

[52] U.S. Cl. ..... 439/497; 439/498

[58] Field of Search ..... 439/492–499, 439/92, 98, 99, 736

[56] References Cited

U.S. PATENT DOCUMENTS

| | | | |
|---|---|---|---|
| 4,083,615 | 4/1978 | Volinskie | 439/494 |
| 4,750,266 | 6/1988 | Brandeau | 439/494 |
| 4,834,674 | 5/1989 | Beamenderfer et al. | 439/494 |
| 4,875,877 | 10/1989 | Fleak et al. | 439/497 |
| 4,973,264 | 11/1990 | Kamono et al. | 439/498 |
| 5,085,595 | 2/1992 | Koegel et al. | 439/494 |

*Primary Examiner*—David L. Pirlot

[57] ABSTRACT

An electrical connector establishing daisy chain connections of wires to electrical contacts, comprises, a first set of electrical contacts (9) on an insulative housing block (16), wire connecting portions (21, 23) of the contacts (9) for connection to first electrical wires (2, 5), and means on the contacts (9) for joining to a second set of electrical contacts (9) connecting with second electrical wires (2, 5) for establishing daisy chain connections of the first wires (2, 5) and the second wires (2, 5) to the first and second sets of electrical contacts (9).

8 Claims, 8 Drawing Sheets

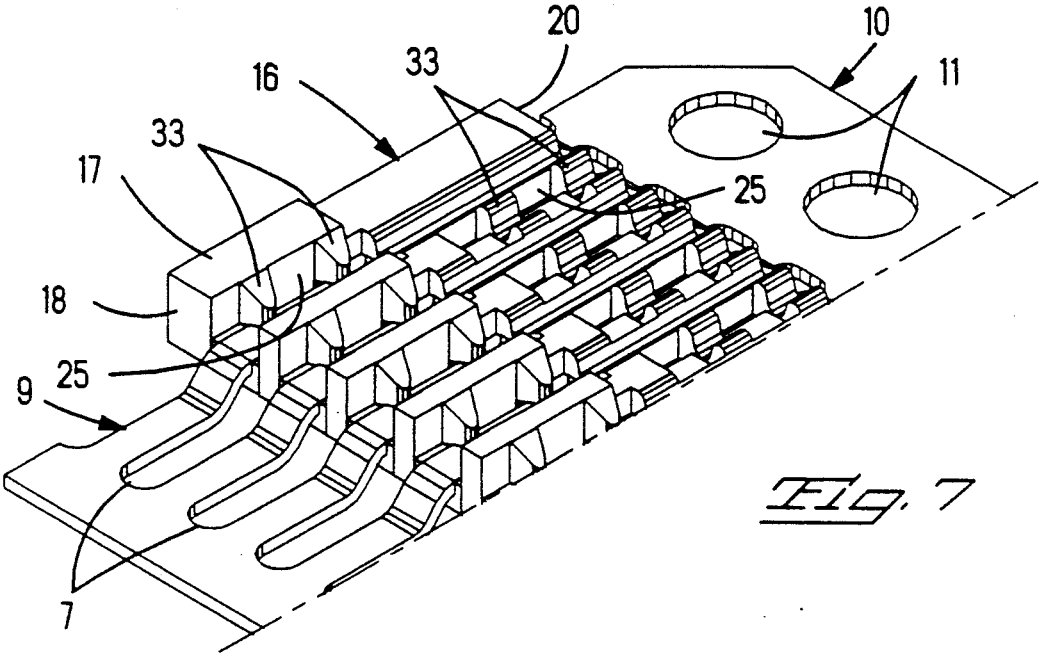
Fig. 7
Fig. 8
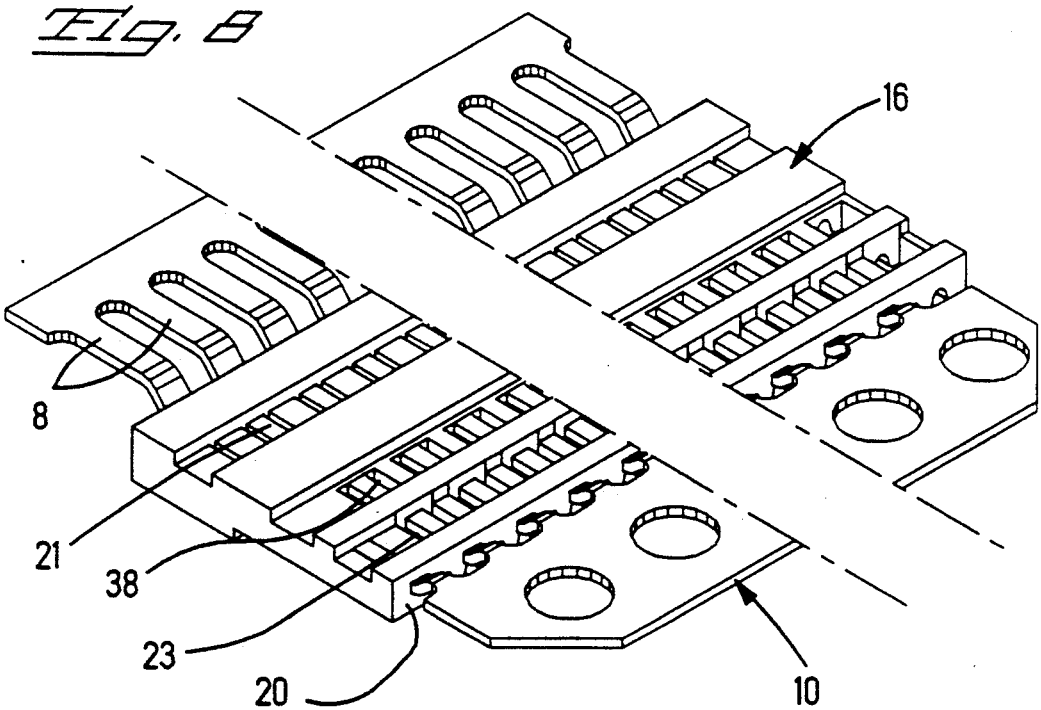

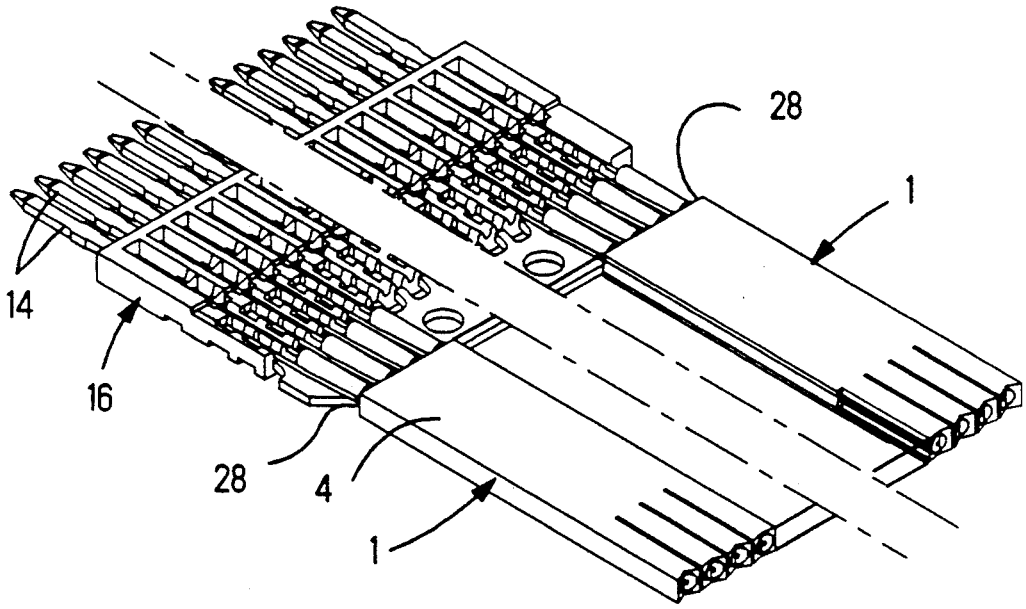
Fig. 9
Fig. 10
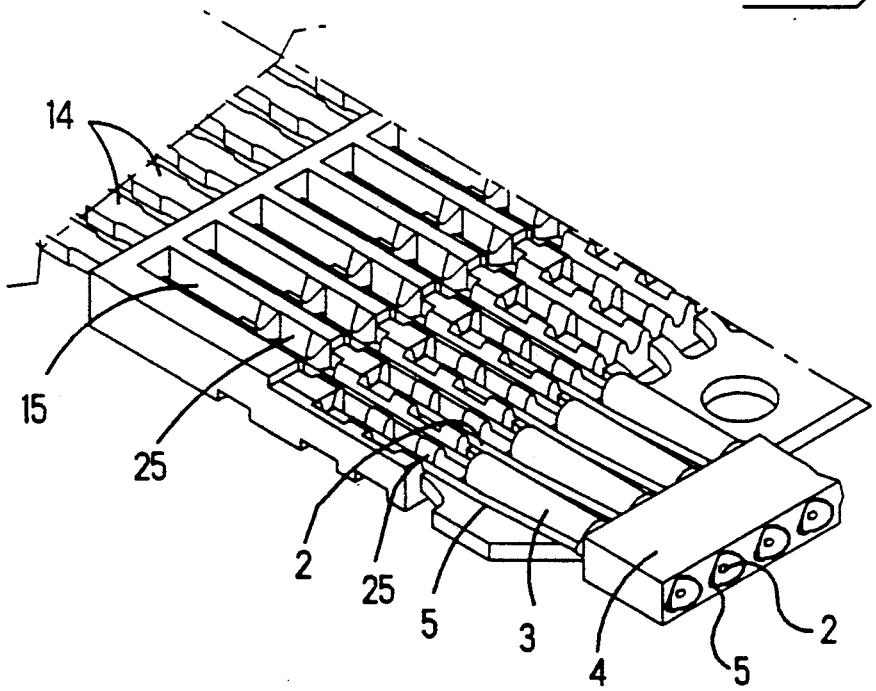

Fig. 12
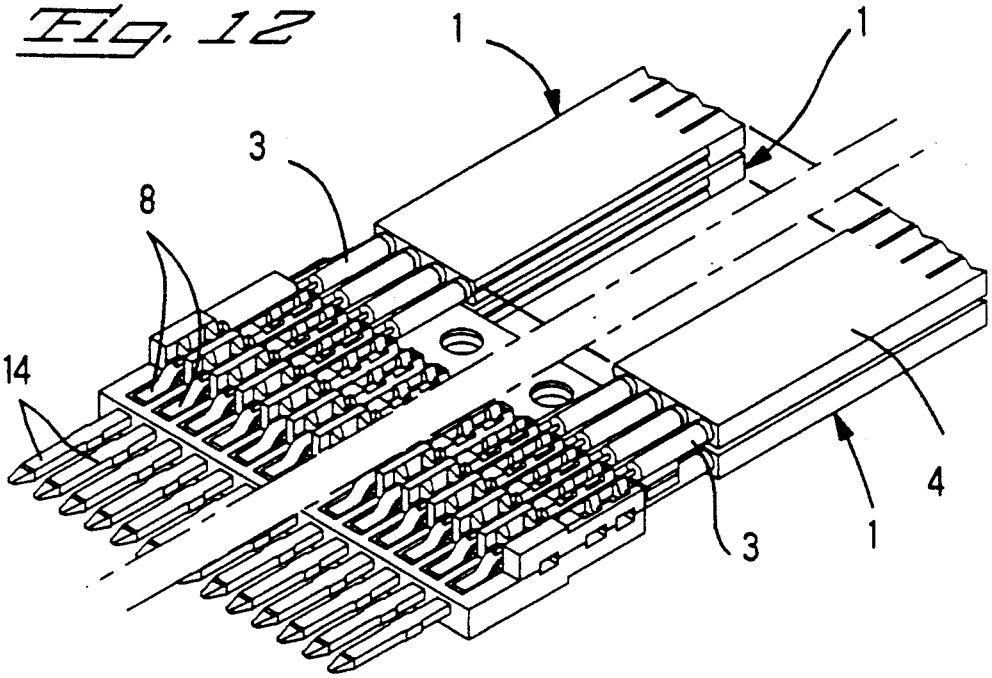
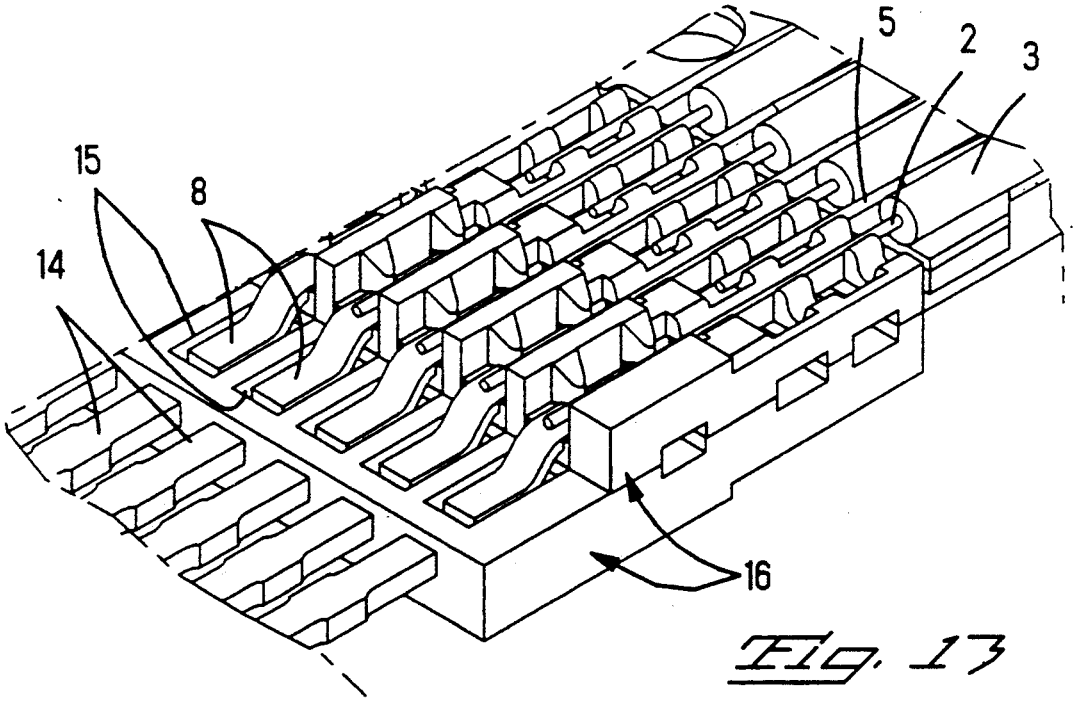
Fig. 13

LEAD FRAME AND ELECTRICAL CONNECTOR

FIELD OF THE INVENTION

The invention relates to an electrical connector establishing daisy chain connections of electrical wires to electrical contacts of the connector.

BACKGROUND OF THE INVENTION

According to U.S. Pat. No. 4,875,877, an electrical connector assembly is provided wherein, wire connecting portions of the signal contacts appear at corresponding first openings of the housing block, the wire connecting portions of the ground bus appear at corresponding second openings of the housing block, and each of the signal contacts is insulated by the housing block to allow stacking of the signal contacts with other similar signal contacts insulated by a second housing block, whereby the first recited housing block and the second housing block combine to form a unitary electrical connector assembly.

Each of the first and second openings extends through opposite sides of the housing block to receive an opposed pair of welding electrodes for clamping therebetween a corresponding wire and a corresponding wire connecting portion. Each of the contacts is constructed for being detached from the ground bus by severing, whereby selected signal contacts are detached from the ground bus and at least one or more other selected signal contacts remain joined to the ground bus.

The connector assembly is constructed for ease of manufacture. For example, the contacts and the ground bus are joined together in a lead frame to eliminate separate parts. The housing block advantageously holds the contacts in desired positions when the contacts are connected to the wires. The contacts are held on pitch spacings that correspond to the pitch spacings of contact receiving cavities of an insulative housing. The contacts are assembled into the cavities of the housing as a group, rather than as individual contacts.

SUMMARY OF THE INVENTION

Further according to the invention, the housing block has a thin construction for stacking together multiple such housing blocks to provide closely spaced rows of contacts in a connector assembly.

The invention will now be described by way of example in reference to a following detailed description taken in conjunction with accompanying drawings, according to which;

DESCRIPTION OF THE DRAWINGS

FIG. 7 is an enlarged view of a portion of FIG. 6;

FIG. 8 is a fragmentary perspective view of an under side of the structure shown in FIG. 6;

FIG. 9 is a fragmentary perspective view of electrical cable connected to the structure shown in FIG. 3;

FIG. 10 is an enlarged view of a portion of FIG. 9;

FIG. 12 is a fragmentary perspective view of a connector assembly wherein the lead frames of FIGS. 1 and 2 are assembled together;

FIG. 13 is an enlarged view of a portion of FIG. 12; and

DETAILED DESCRIPTION

Figure 1:
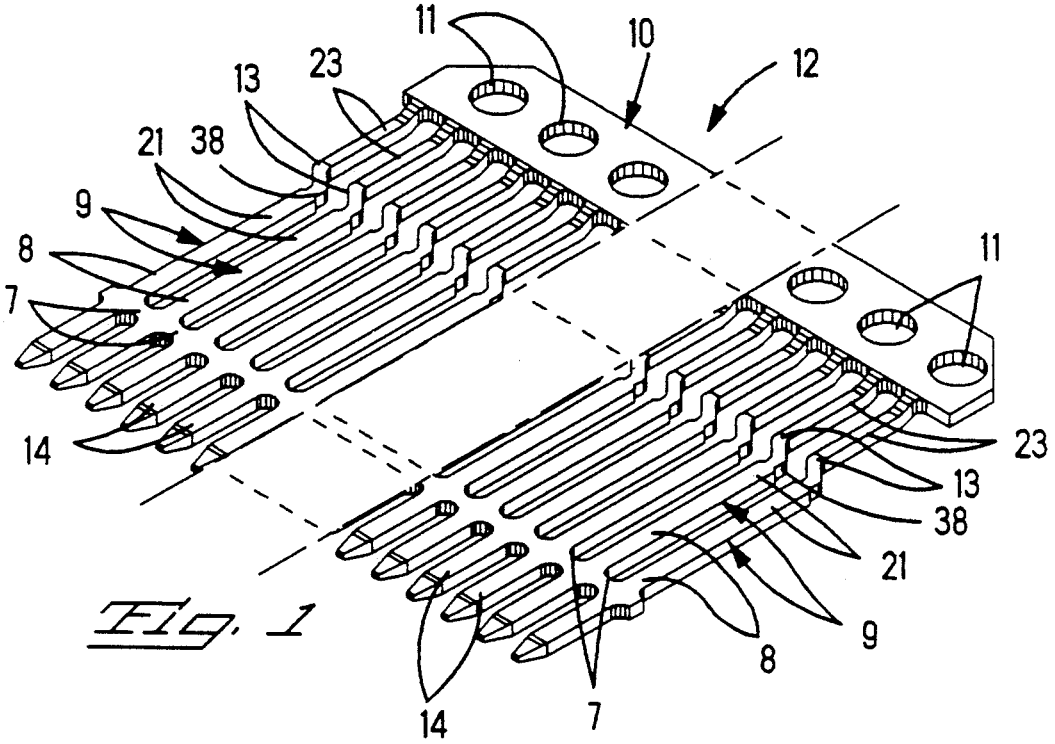
FIG. 1 is a fragmentary perspective view of a first lead frame of a connector.

With reference to FIGS. 9 and 10, an electrical cable 1 is constructed with an elongated signal wire 2 or center conductor concentrically encircled by a dielectric 3, in turn encircled by a flexible insulative outer jacket 4 or sheath. A corresponding, elongated and conductive ground wire 5 or drain wire extends along the exterior of the dielectric 3 and is within the jacket 4. The cable 1 may include a single ground wire 5, as shown, or may include first and second ground wires 5, not shown, to provide a combination of a signal wire 2 between two ground wires 5. The invention applies to either cable construction, or to any other cable construction, not shown. The cable construction is cut to expose and to project the signal wire 2, the dielectric 3 and the corresponding ground wire 5 from the jacket 4. An electrical connector assembly 6, FIG. 10, is to be connected to one or multiple cables 1 in a manner described below with reference to FIGS. 1 through 10.

Figure 2:
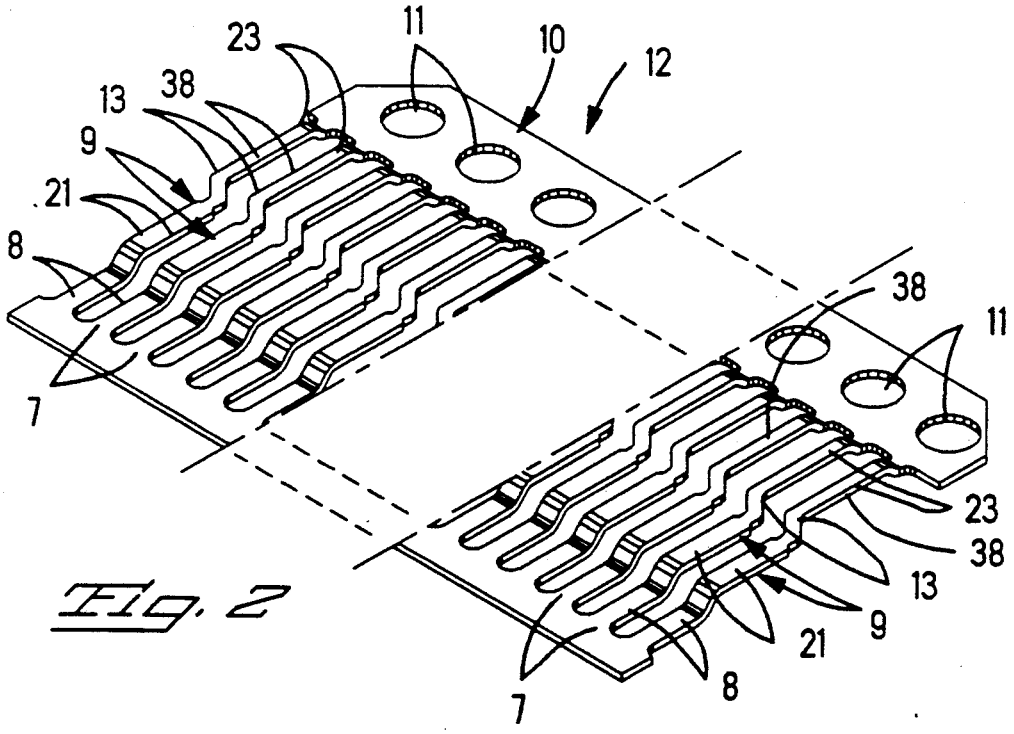
FIG. 2 is a fragmentary perspective view of a second lead frame of another connector.

Construction of the connector assembly 6 begins with two sets of elongated electrical contacts 9, FIGS. 1 and 2, with the contacts 9 of each set in a row. The following description applies to each set. The contacts 9 project forwardly from an elongated ground bus 10. A series of pilot holes 11 extend through the ground bus 10. The contacts 9 when joined to the ground bus 10 provide a lead frame 12, known as an array of conductive paths for conducting electricity, with the paths joined together and cut out from a strip of metal. The contacts 9 are on pitch spacings, that are the repeated spacings between longitudinal axes of the multiple contacts 9 in a row. Webs 7 of the strip bridge between adjacent contacts 9. The webs 7 of one of the sets, FIG. 2, bridge across front ends of the contacts and define a unitary carrier strip holding the contacts 9 on desired coplanar pitch spacings. The webs 7 of another of the sets bridge across the contacts 9 near electrical terminals 14, FIG. 1, and hold the contacts 9 on desired coplanar pitch spacings. Only the contacts 9 of one of the sets, FIG. 1, include corresponding electrical terminals 14. Each terminal 14 is a post or pin. The terminal 14 can also be constructed with an electrical receptacle, not shown, in place of the post or pin.

With reference to FIGS. 3 through 8, a corresponding housing block 16 is applied to each set of contacts 9. For example, the housing block 16 is formed by injection molding a fluent plastics material that embeds the contacts 9. A front end 17 of the housing block 16 is formed with a front wall 18 extending transverse to the row of contacts 9. Removable portions 19 of the ground bus 10 attach to the ground bus 10 having the pilot holes 11 and serving as a carrier strip. The housing block 16 extends to a rear wall 20 from which the ground bus 10 projects. Wire connecting portions 21 of the contacts 9 appear at corresponding spaced apart, openings 22 formed by molding the housing block 16. Wire connecting portions 23 of the ground bus 10 extend from the ground bus 10. The housing block 16 holds all the corresponding contacts 9 on a desired pitch spacing, and holds the contacts 9 and the ground bus 10 before and after selected contacts 9 are detached from the ground bus 10.

A feature of the invention resides in the wire connecting portions 21, 23 and the removable portion 19 being in tandem, and being spaced apart along the length of a corresponding contact 9. The longitudinal axis of the corresponding contact 9 is offset laterally at 13 in the plane of a corresponding set of contacts 9 to position the wire connecting portion 23 offset laterally of the wire connecting portion 21. Thereby, a ground wire 5 and a signal wire 2 can be located side by side while they are connected to corresponding wire connection portions 21, 23 of a corresponding contact 9, which wire connecting portions 21, 23 are offset laterally in the plane and row of a corresponding set of contacts 9. The wire connecting portion 23 of the ground bus 10 is between the ground bus 10 and the removable portion 19, and between the wire connecting portions 21 and the wire connecting portions 23, to remain connected to the ground bus 10 when the removable portion 19 is severed, for example, thereby to remove an electrical connection of the ground bus 10 to a corresponding contact 9, and further to remove an electrical connection of the wire connecting portion 23 to the wire connecting portion 21 of a corresponding contact 9.

Figure 3:
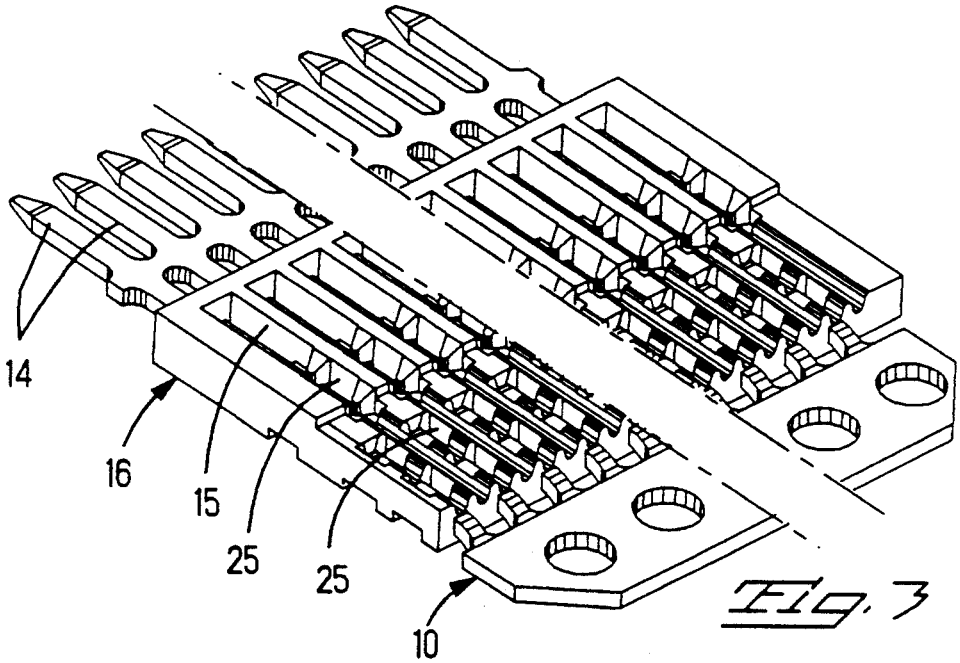
FIG. 3 is a fragmentary perspective view of the first lead frame on an insulative housing block.
Figure 4:
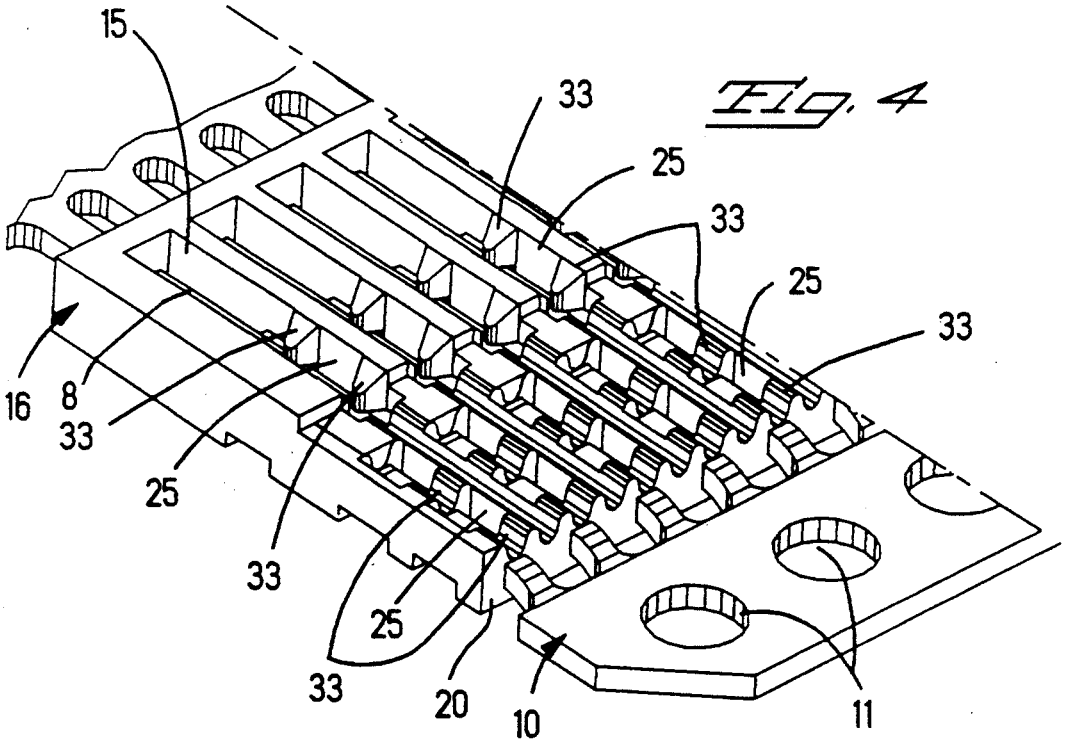
FIG. 4 is an enlarged view of a portion of FIG. 3.
Figure 5:
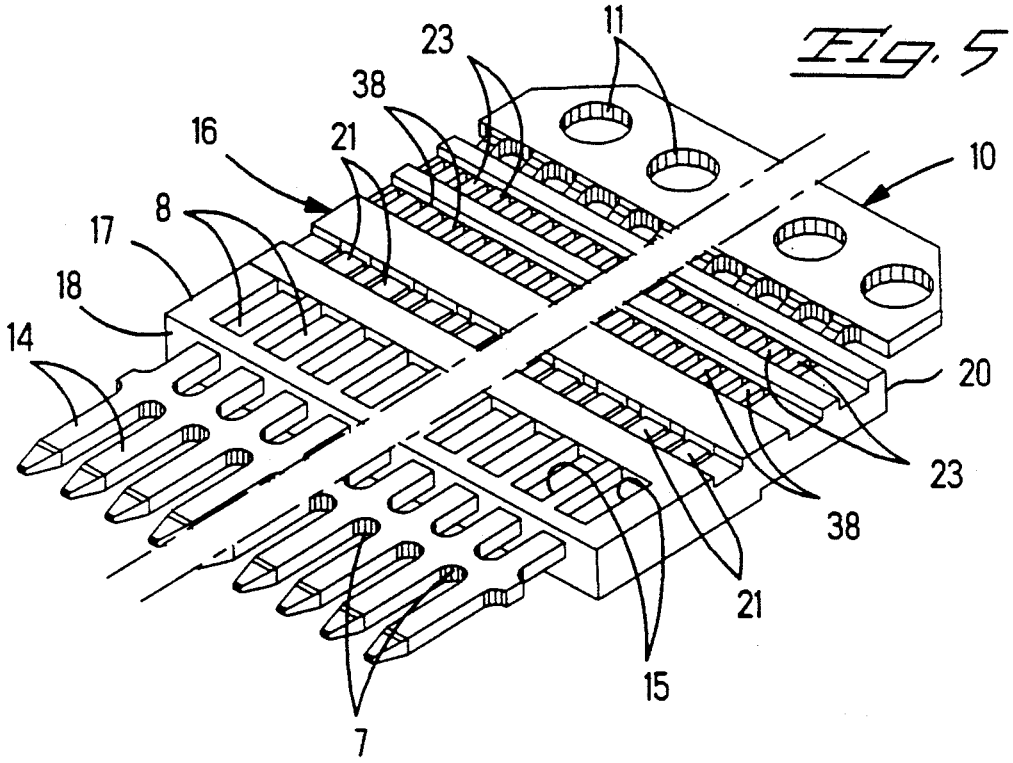
FIG. 5 is a fragmentary perspective view of an under side of the structure shown in FIG. 3.
Figure 6:
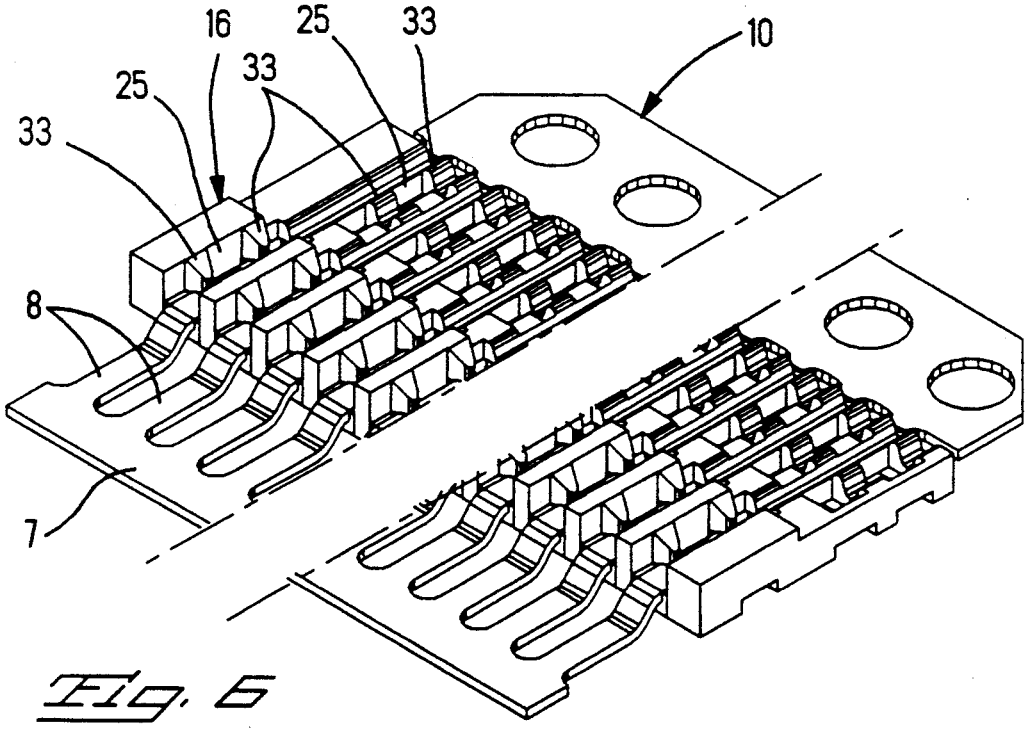
FIG. 6 is a fragmentary perspective view of the second lead frame on an insulative housing block.

Wire receiving channels 25, FIGS. 3 and 6, formed by molding the housing block 16, extend from the rear wall 20 forwardly and axially of corresponding contacts 9 and corresponding wire connecting portions 21, 23. The channels 25 intercept corresponding wire connecting portions 21, 23. An end 28, FIGS. 9 and 10, of the jacket 4 of a corresponding cable 1 opposes the rear wall 20. The signal wire 2 of the cable 1 and each ground wire 5 of the cable 1 extend along corresponding channels 25. The signal wire 2 extends along the channel 25 to the wire connecting portion 21 of a corresponding contact 9. Each corresponding ground wire 5 extends along a corresponding channel 25 to the wire connecting portion 23. Each of the corresponding channels 25 that intercept the wire connecting portions 23 is shorter than each of the corresponding channels 25 that intercept the wire connecting portions 21.

Further details of construction of the housing block 16 are described in U.S. Pat. No. 4,875,877, according to which, wire gripping portions 33, FIGS. 3, 4, 6 and 7, of the housing block 16 are provided for gripping and positioning the wires 2 and 5 along corresponding wire connecting portions 21 and 23, and further according to which, the connection between a corresponding wire 2 or 5 and a corresponding wire connecting portion 21 or 23 is accomplished by a welding operation or a soldering operation. Each contact 9 that is connected to a signal wire 2 is designated a signal contact. Each contact 9 that remains connected to the ground bus 10 is designated a ground contact. Each contact 9 is joined to the lead frame 12 by a removable portion 38 of the lead frame 12. Removal of a removable portion 38 from a corresponding contact 9, for example, by severing, and as further described in U.S. Pat. No. 4,847,877, will designate that contact 9 as a signal contact, and not a ground contact.

The coplanar contacts 9 are held in precise alignment when the insulative material of the housing block 16 is applied, for example, by an injection molding process, not shown. The solidified housing block 16 holds the contacts 9 in desired positions, including desired pitch spacings.

Figure 11:
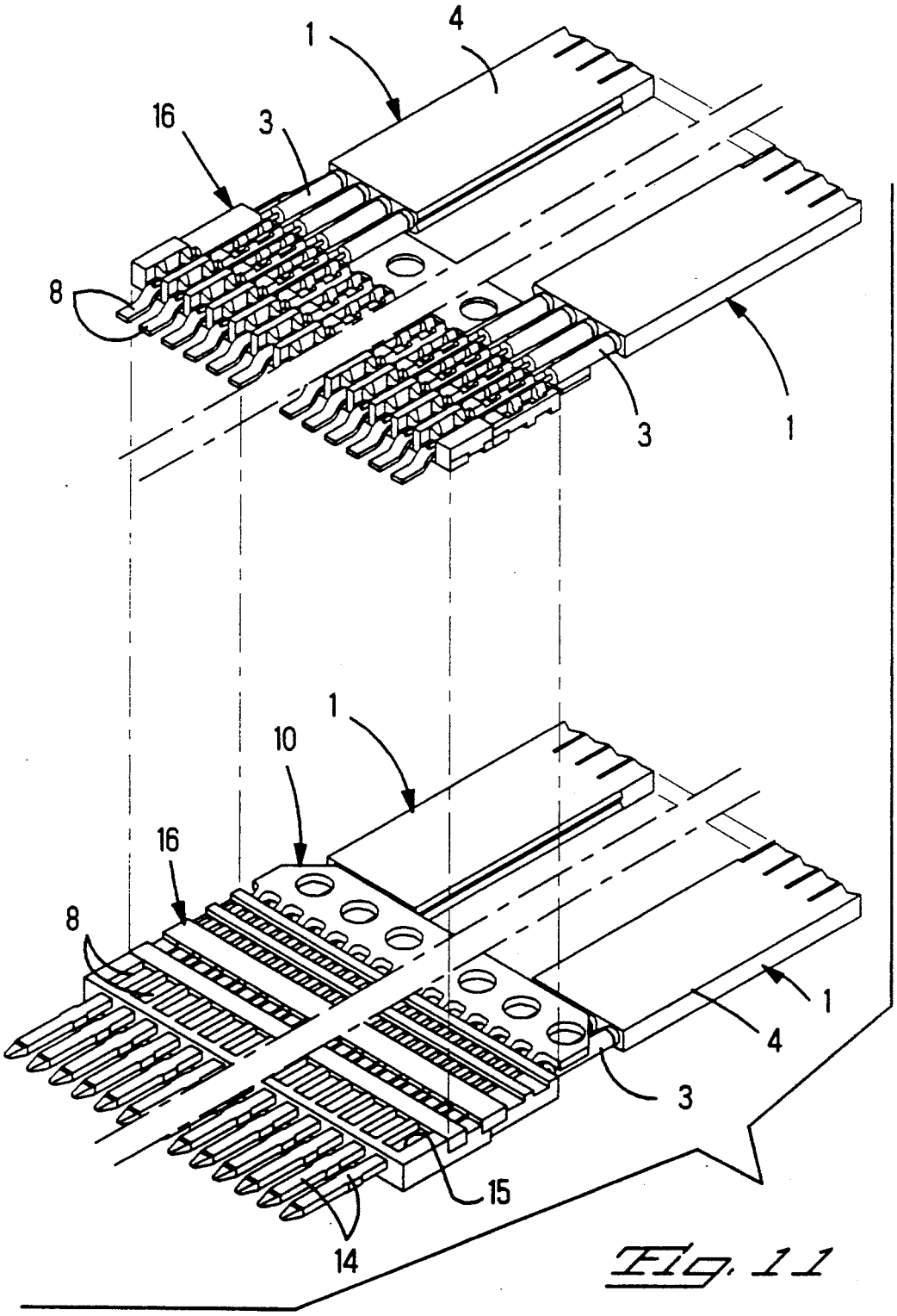
FIG. 11 is a fragmentary perspective view of the lead frames of FIGS. 1 and 2 connected with corresponding wires, and ready for assembly together to form daisy chain connections of the wires of one lead frame to the other.
Figure 14:
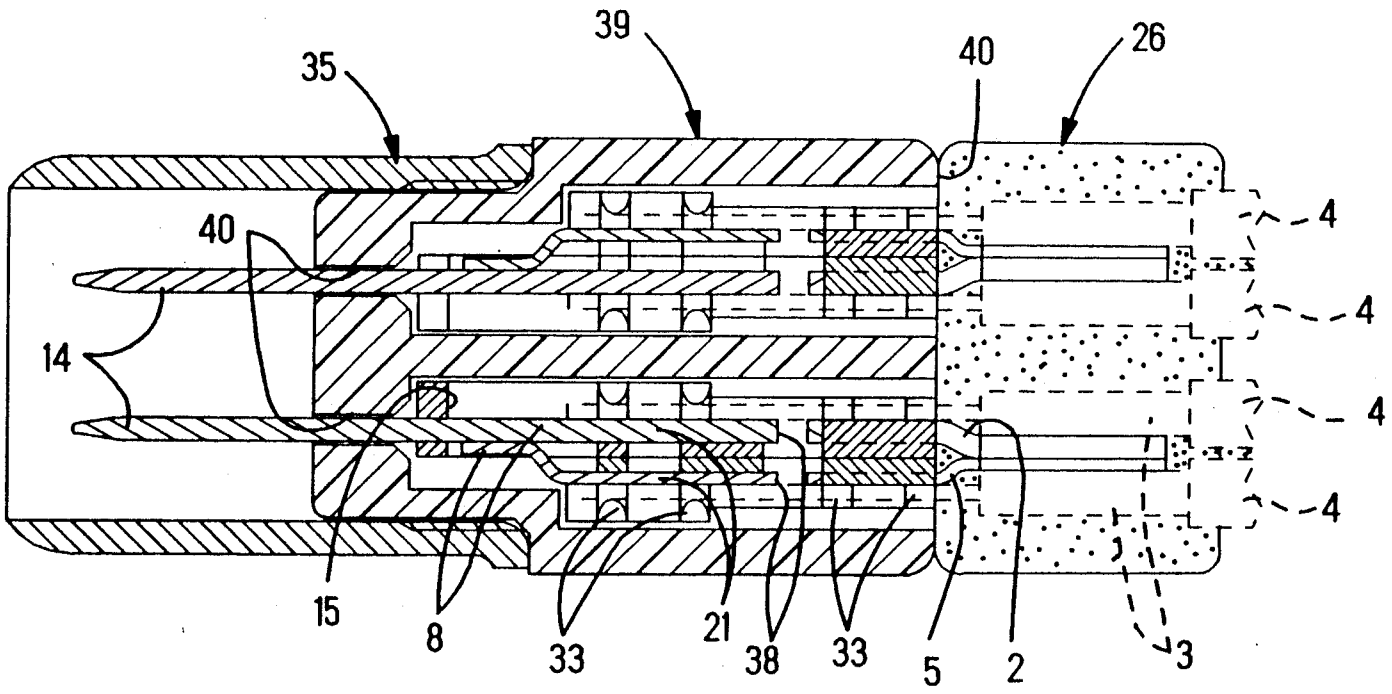
FIG. 14 is an elevation view in section of the connector assembly of FIG. 12 combined with insulative material, a housing and a shell.

Reference will now be made to FIGS. 9 through 11. After solidification of the housing block 16, the lead frame 12 is subjected to a stamping operation to sever and remove selected ones of the removable portions 38, leaving ground contacts connected to the ground bus 10, and to sever and remove the webs 7, separating adjacent contacts 9 and separating adjacent terminals 14. The removable portions 19 are removed by severing.

The set of contacts 9 that formerly were connected at front ends by the webs 7, now with the webs 7 removed have means 8 for joining to contacts 9 of the other set. The means 8 comprises tabs at the ends of the contacts 9 of flat rectangular shapes or, alternatively, portions of the contacts 9 of other shapes and of other locations along the contacts 9. The contacts 9 of the set having the terminals 14 have means 8 for joining to contacts 9 of the other set, which means 8 are exposed in corresponding recesses 15 in the housing block 16 aligned with the contacts 9. The recesses 15 open to opposite sides of the housing block 16 and provide access for welding electrodes, not shown, to enter the recesses 15 from opposite sides of the housing block 16 and clamp onto the means 8, 8 of both sets of contacts 9 and weld the means 8, 8 together.

Prior to joining the contacts 9 of one set with the contacts 9 of the other set, each set is connected first to corresponding wires 2, 5 in the following manner. A corresponding signal wire 2 and a corresponding ground wire 5 of at least one cable 1 are routed along corresponding channels 25 of a corresponding housing block 16, such that the wires 2 and 5 are held by corresponding wire gripping portions 33 in respective openings 22 while engaging corresponding wire connecting portions 21, 23. Additional wires 2 and 5 of one or multiple cables 1 are similarly assembled to fill corresponding channels 25. Then the wires 2 and 5 are welded, or soldered to corresponding wire connecting portions 21, 23. Thereby, the invention provides two electrical connector assemblies. Each assembly is comprised of, a set of contacts 9 and a ground bus 10 for connection to corresponding wires 2, 5, and means 15 on the contacts 9 for joining the contacts 9 with contacts 9 of the other set for establishing daily chain connection of the wires 2, 5 of one set to the wires 2, 5 of the other set.

A feature of the invention will now be described with reference to FIG. 13. The contacts 9 project forward of the housing block 16 for assembly within a rear of an insulative housing 39. The housing 39 is received in a rear of an outer shell 35, and includes multiple contact receiving cavities 40 in a row and spaced apart on pitch spacings corresponding to that of the series of contacts 9. Representative contacts 9 are shown fully assembled in corresponding, representative cavities 40 in representative rows. Molded insulative material 26 embeds the wire engaging portions 21, 23 and portions of corresponding wires 2, 5. The material 26 engages a rear 41 of the housing 39. Since two rows of contacts 9 are received in the housing 39, two sets of daisy chain connections are brought together in one housing 39.

We claim:

1. An electrical connector assembly comprising: a first set of conductive electrical contacts on an insulative first housing block connected to a first set of wires, a second set of conductive electrical contacts on an insulative second housing block connected to a second set of wires, the contacts of the first set being joined to respective contacts of the second set to establish daisy chain connections of the sets of wires to joined contacts, the contacts of the first set extend in recesses of the first housing block, the contacts of the second set extend outward from the second housing block and register in the recesses, and the recesses being open to opposite sides of the first housing block to admit means for joining the contacts of the second set and the contacts of the first set in the recesses.

2. An electrical connector assembly as recited in claim 1 and further including: carrier strips for the sets of contacts are on respective housing blocks, and openings in the housing blocks exposing removable metal portions connecting the contacts to the carrier strips.

3. An electrical connector assembly as recited in claim 1 and further including: wire alignment channels in the housing blocks receiving corresponding wires of the first and second sets.

4. An electrical connector assembly as recited in claim 1 and further including: electrical terminals on the contacts of the first set, the daisy chain connections of the wires being established to the terminals.

5. An electrical connector assembly as recited in claim 1 and further including: tabs for joining to the electrical contacts by welding.

6. An electrical connector assembly as recited in claim 1, and further including: tabs for joining to the electrical contacts by soldering.

7. An electrical connector assembly as recited in claim 1 wherein, each contact has first and second wire connecting portions and a removable portion in tandem along the contact.

8. An electrical connector assembly as recited in claim 1 wherein, the wire connecting portion is between the first and second wire connecting portions.

* * * * *